US008807148B2

(12) United States Patent
Hermouet

(10) Patent No.: US 8,807,148 B2
(45) Date of Patent: Aug. 19, 2014

(54) KIT INCLUDING A MATERIAL APPLICATION DEVICE, AND USE OF SUCH KIT

(75) Inventor: Yannic Hermouet, Saran (FR)

(73) Assignee: Parfums Christian Dior, Paris (FR)

( * ) Notice: Subject to any disclaimer, the term of this patent is extended or adjusted under 35 U.S.C. 154(b) by 214 days.

(21) Appl. No.: 13/510,515

(22) PCT Filed: Nov. 9, 2010

(86) PCT No.: PCT/FR2010/052403

§ 371 (c)(1),
(2), (4) Date: Aug. 1, 2012

(87) PCT Pub. No.: WO2011/064482

PCT Pub. Date: Jun. 3, 2011

(65) Prior Publication Data

US 2012/0305023 A1 Dec. 6, 2012

(30) Foreign Application Priority Data

Nov. 25, 2009 (FR) ..... 09 58372

(51) Int. Cl.
*A45D 40/16* (2006.01)
*A45D 40/00* (2006.01)

(52) U.S. Cl.
CPC ..... *A45D 40/16* (2013.01); *A45D 2040/0062* (2013.01); *A45D 2040/0043* (2013.01)
USPC ..... 132/318

(58) Field of Classification Search
USPC ..... 132/318, 317; 401/52, 61–64
See application file for complete search history.

(56) References Cited

U.S. PATENT DOCUMENTS

| | | | | |
|---|---|---|---|---|
| 2,858,937 | A * | 11/1958 | Hoffman | 401/78 |
| 3,343,668 | A * | 9/1967 | Politzer | 401/52 |
| 3,429,643 | A * | 2/1969 | Seaver | 401/75 |
| 5,893,672 | A * | 4/1999 | Erickson | 401/52 |
| 6,193,725 | B1 * | 2/2001 | Macey | 606/104 |
| 6,340,258 | B2 | 1/2002 | Gueret | |

FOREIGN PATENT DOCUMENTS

| | | | |
|---|---|---|---|
| DE | 4201064 | A1 | 7/1993 |
| DE | 4227387 | A1 | 2/1994 |
| EP | 0970635 | B1 | 1/2000 |
| EP | 1803369 | A2 | 7/2007 |

(Continued)

OTHER PUBLICATIONS

French Search Report from corresponding French Patent Application No. FR 0958372 Report Dated Jul. 19, 2010.

(Continued)

*Primary Examiner* — Robyn Doan
(74) *Attorney, Agent, or Firm* — Miller, Matthias & Hull LLP

(57) ABSTRACT

The invention relates to a kit including an application device and an extracting member. The application device comprises a protective tube extending in a longitudinal direction, an interchangeable cartridge, and a control mechanism for sliding the cartridge into the protective tube. The cartridge comprises a stick of material held by a cup that comprises an inner lip. In order to extract the cartridge from the application device when said cartridge is used, the stick of material can be penetrated by the extracting member that comprises an outer lip suitable for holding the inner lip of the cup.

20 Claims, 19 Drawing Sheets

(56) References Cited

FOREIGN PATENT DOCUMENTS

| | | | |
|---|---|---|---|
| FR | 1118991 | A | 6/1956 |
| FR | 2873001 | A1 | 1/2006 |
| GB | 655718 | A | 8/1951 |
| WO | WO 2008/042609 | A1 | 4/2008 |

OTHER PUBLICATIONS

International Search Report from corresponding International Patent Application No. PCT/FR2010/052403 Report Dated Nov. 9, 2010.

* cited by examiner

KIT INCLUDING A MATERIAL APPLICATION DEVICE, AND USE OF SUCH KIT

CROSS-REFERENCE TO RELATED APPLICATIONS

This application is a 35 USC §371 U.S. national stage filing of International Patent Application No. PCT/FR2010/052403 filed on Nov. 9, 2010, which claims priority under the Paris Convention and 35 USC §119 to French Patent Application No. 09 58372, filed on Nov. 25, 2009.

FIELD OF THE DISCLOSURE

The invention relates to kits comprising material application devices, particularly for cosmetic materials, and the use of such kits.

BACKGROUND OF THE DISCLOSURE

Material application devices are known which comprise:

- a protective tube extending in a longitudinal direction between first and second ends, the second end being open,
- an interchangeable cartridge contained in the protective tube, comprising a cup and a stick of material, said stick of material extending in said longitudinal direction between a proximal end inside the cup and a distal end at a distance from said cup,
- a control mechanism, adapted to move the stick of material in the protective tube in the longitudinal direction so that at least a portion of the stick of material protrudes from the second end of the protective tube, said control mechanism comprising a sliding element to which the cup is removably attached.

Document GB-A-655 718 describes an example of such an application device, intended in particular for lipstick. In this known device, the cup of the cartridge has radially projecting tabs on its lip that are engageable with grooves arranged at the open end of a refill tube. The refill tube contains the cartridge before it is placed in the application device, and also allows removing the used cartridge from the application device.

One disadvantage of this known device is that the radial tabs of the cup are projecting. Because of this, these radial tabs impose constraints on the design of the application device and limit its compactness. In addition, said radial tabs could be a nuisance to the user when applying the material, particularly when the stick of material is at the end of its service life.

SUMMARY OF THE DISCLOSURE

An object of the invention is to overcome these disadvantages.

The invention therefore proposes a kit comprising:

a) a material application device including:

- a protective tube extending in a longitudinal direction between first and second ends, the second end being open,
- an interchangeable cartridge contained in the protective tube, this cartridge containing a cup and a stick of material, said stick of material extending in said longitudinal direction between a proximal end engaged inside the cup and a distal end at a distance from said cup, the cup comprising an inner lip which is covered by the stick of material inside the cup,

- a control mechanism for moving the stick of material in the protective tube in the longitudinal direction, such that at least a portion of the stick of material exits the second end of the protective tube, said control mechanism comprising a sliding element to which the cup is removably attached, b) an extracting member adapted to penetrate the stick of material, said extracting member having an outer lip which is solidly attached to said inner lip after penetration into the stick of material, such that the cartridge can be extracted from the application device.

By these arrangements, a used cartridge can be easily and cleanly extracted from the application device without the cup of the cartridge having external radial tabs.

In some embodiments of the kit of the invention, one or more of the following arrangements may be used:

- the cup comprises a bottom and a lateral wall into which the proximal end of the stick of material is inserted, said inner lip protruding radially inward from said lateral wall;
- said inner lip is an annular lip having a shoulder directed towards the bottom of the cup;
- said inner lip is a thread;
- the cup comprises a bottom in which there is an opening delimited by said inner lip;
- the stick of material consists of a paste-like material;
- the stick of material consists of a material intended to be applied to the lips, for cosmetic use such as lipstick, or for pharmaceutical use;
- the kit additionally comprises a refill containing an interchangeable cartridge removably housed in a casing which comprises a refill housing extending in an axial direction between first and second ends, the second end being open, said cartridge comprising a cup and a stick of material, the bottom of the cup being placed towards the second end of the refill housing so it can be mounted onto the sliding element of the application device, said stick of material of the refill extending longitudinally in the axial direction between a proximal end engaged inside the cup and a distal end at a distance from said cup, the cup of the refill comprising an inner lip which is covered by the stick of material inside the cup, the stick of material of the refill being penetrable by said extracting member which is adapted to be solidly attached to said inner lip of the refill cup to allow extraction of the refill cartridge when it is assembled onto the application device;
- the refill cup is fitted into the second end of the refill housing, and said refill housing comprises a shoulder which is directed towards the second end of said refill housing such that it can press against the cup in the axial direction;
- the refill comprises a cap for closing the second end of the refill housing;
- the cap comprises two arms pivotably mounted on two respective pivots on each side of the refill casing, said arms being adapted to slide relative to the casing between a closed position in which the cap closes the second end of the refill housing and a released position in which the cap is moved away from said second end of the refill housing, the released position being such that the cap is sufficiently distanced from said second end of the refill housing to allow said cap to pivot and leave unobstructed said second end of the refill housing;
- the extracting member is integrally attached to the refill casing, said extracting member comprising an outer lip which cooperates with the inner lip of the cup to retain said cup and enable extraction of the cartridge when it is assembled onto the application device;

the refill casing additionally comprises an extraction housing that is open opposite the refill housing and at least partially contains said extracting member, said extraction housing being adapted to house a cartridge extracted from an application device and retained by the extracting member;

the cup of the cartridge comprises a bottom and a lateral wall into which the proximal end of the stick of material is engaged, said inner lip protruding radially inwards from said lateral wall;

the outer lip of the extracting member is adapted to catch on the inner lip of the cartridge when it is assembled onto an application device;

the inner lip of the cup is annular and comprises a shoulder directed towards the bottom of the cup;

the outer lip of the extracting member is annular and comprises a shoulder directed towards the refill housing, and the extracting member is in the form of a ferrule;

said inner lip of the cup is a thread and the outer lip of the extracting member is a complementary thread adapted to screw into the inner lip of the cup;

the bottom of the cup comprises an opening delimited by said inner lip and the extracting member comprises at least one shaft which extends out to a free end having a protruding head comprising said outer lip, which is adapted to catch on the inner lip of the cup.

Another object of the invention is the use of a kit as defined above, in which:

the extracting member penetrates into the stick of material in the cartridge of the application device, the outer lip of said extracting member is solidly attached to said inner lip of the cup, and the cartridge is extracted with the aid of the extracting member.

BRIEF DESCRIPTION OF THE DRAWINGS

Other features and advantages of the invention will be apparent from reading the following description of some of its embodiments, provided as non-limiting examples, with reference to the attached drawings.

In the drawings.

DETAILED DESCRIPTION OF THE DISCLOSURE

Figure 1:
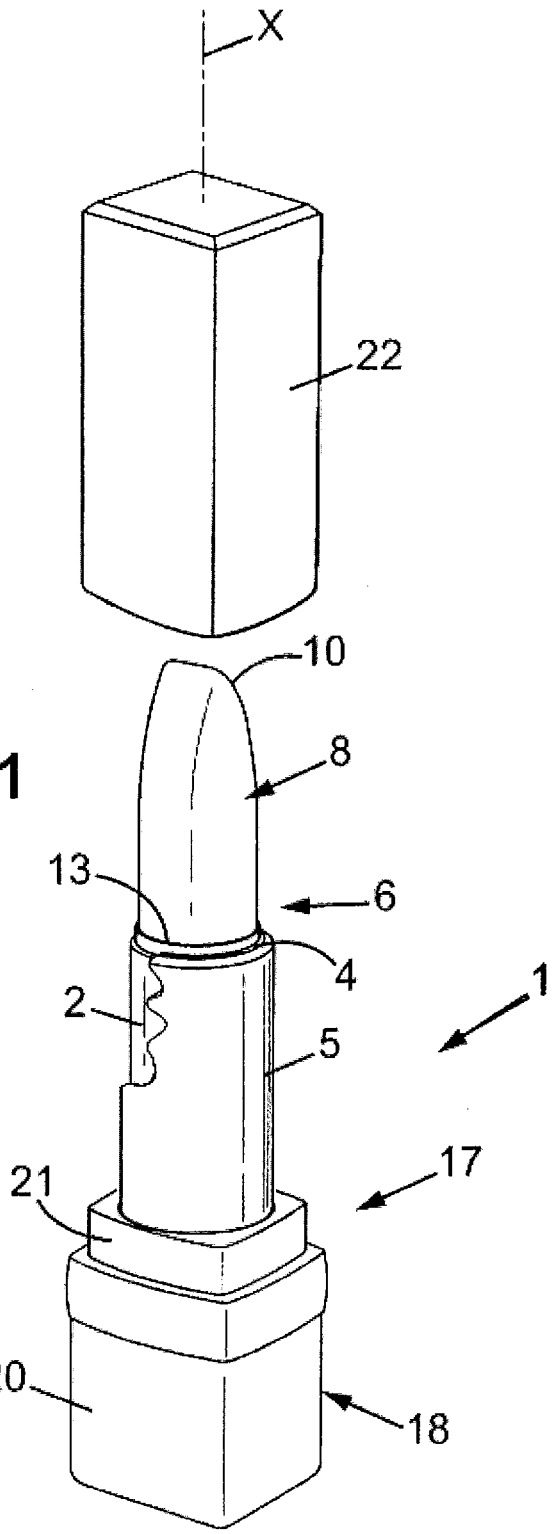
FIG. 1 is a general perspective view, with a partial cutaway section, of a device according to a first embodiment of the invention.

In the various figures, the same references are used to denote identical or similar elements.

A. First Embodiment of the Invention a) Application Device

As can be seen in FIGS. 1 to 4, the application device 1 comprises a protective tube 2 which extends in a longitudinal direction X between first and second ends 3, 4. More specifically, the protective tube 2 can have a generally cylindrical shape of central axis X. The second end 4 is open.

This protective tube 2 may, for example, be made of plastic and may possibly be covered in its visible external areas (meaning the areas near the second end 4) by a decorative metal ferrule.

The protective tube 2 contains an interchangeable cartridge 6 which comprises:

a cup 7, made of plastic for example, and a stick 8 of material; a stick of lipstick is used as an example in all the figures.

The stick 8 of material is generally made of a solid or paste-like material which can be shaped into a stick that remains stable over time at room temperature. This type of solid or paste-like material generally contains a wax or a wax mixture and is deposited by contact with a surface during use. Solid or paste-like material is also understood to mean a material that can be penetrated by a rigid object without losing its integrity when it is shaped into a given form such as a stick.

The stick 8 of material extends in the longitudinal direction X between a proximal end 9 solidly attached to the cup 7 and a distal end 10 close to the second end 4 of the protective tube and adapted to exit the protective tube 2 by this second end 4.

In the example represented in the drawings, the cup 7 defines a certain inside volume into which the proximal end 9 of the stick of material is inserted. More specifically, in this example the cup 7 may have a bottom 11 and a lateral wall 12 having for example a general cylindrical shape centered on the axis X. This lateral wall 12 extends from the bottom 11 to a free end 13, in the direction of the distal end 10 of the stick of material.

In the invention, to facilitate extracting the cartridge 6 of material when the stick 8 of material is at the end of its service life, the cup 7 is equipped with an inner lip which protrudes radially inward and which is covered by the stick 8 of material inside said cup but which can cooperate with an external extracting member that penetrates the stick of material to enable extraction of the used cartridge 6 and its replacement with a new cartridge.

In the first embodiment of the invention, said inner lip of the cup consists of an annular rib 14 arranged on the inside of the lateral wall 12, near the free end 13. As represented in more detail on FIG. 2A, the rib 14 may if applicable have a sloped side 15 and a shoulder 16, with the sloped side extending downward and radially inward, to the shoulder 16, which is directed towards the bottom 11, substantially perpendicular to the central axis X.

Figure 2:
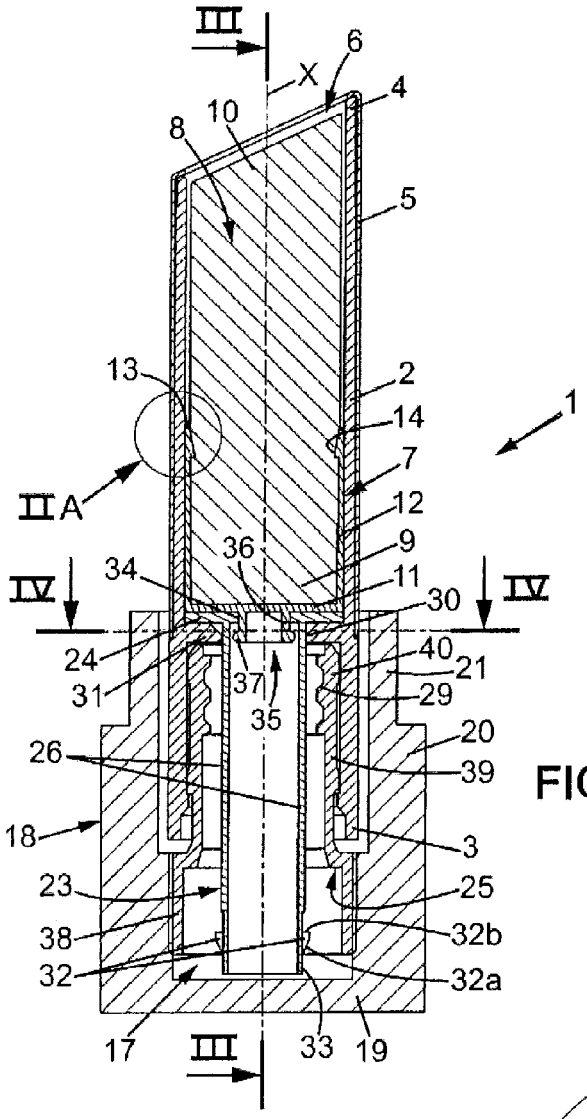
FIG. 2 is an axial cross-sectional view of the application device of FIG. 1, without its cap, showing the plane along line II-II of FIG. 3.
Figure 2A:
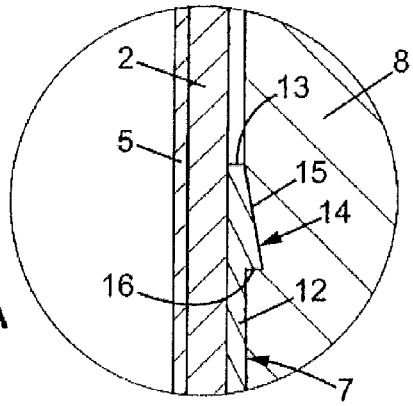
FIG. 2A is an enlarged view of the IIA details of FIG. 2.

As represented in FIGS. 1 and 2, the application device 1 additionally comprises a control mechanism 17 for moving the stick of material between:

- a retracted position (FIG. 2) in which said stick 8 is completely contained in the protective tube 2,
- and a usage position (FIG. 1) in which the stick 8 protrudes from the second end 4 of the protective tube 2.

In the example represented in the drawings, the control mechanism 17 includes a base 18 which forms the lower portion of the application device. This base 18 comprises a bottom 19 which allows placing the application device 1 on a horizontal surface, and a lateral wall 20 which extends along the central axis X from the bottom 19 and surrounds the lower portion of the protective tube 2, near the first end 3 of this protective tube.

The upper portion of the lateral wall 20 of the base 18 may possibly comprise a thinned portion 21 onto which a protective cap can fit 22 (FIG. 1) to cover the protective tube 2 when the stick 8 of material is in the retracted position.

Figure 3:
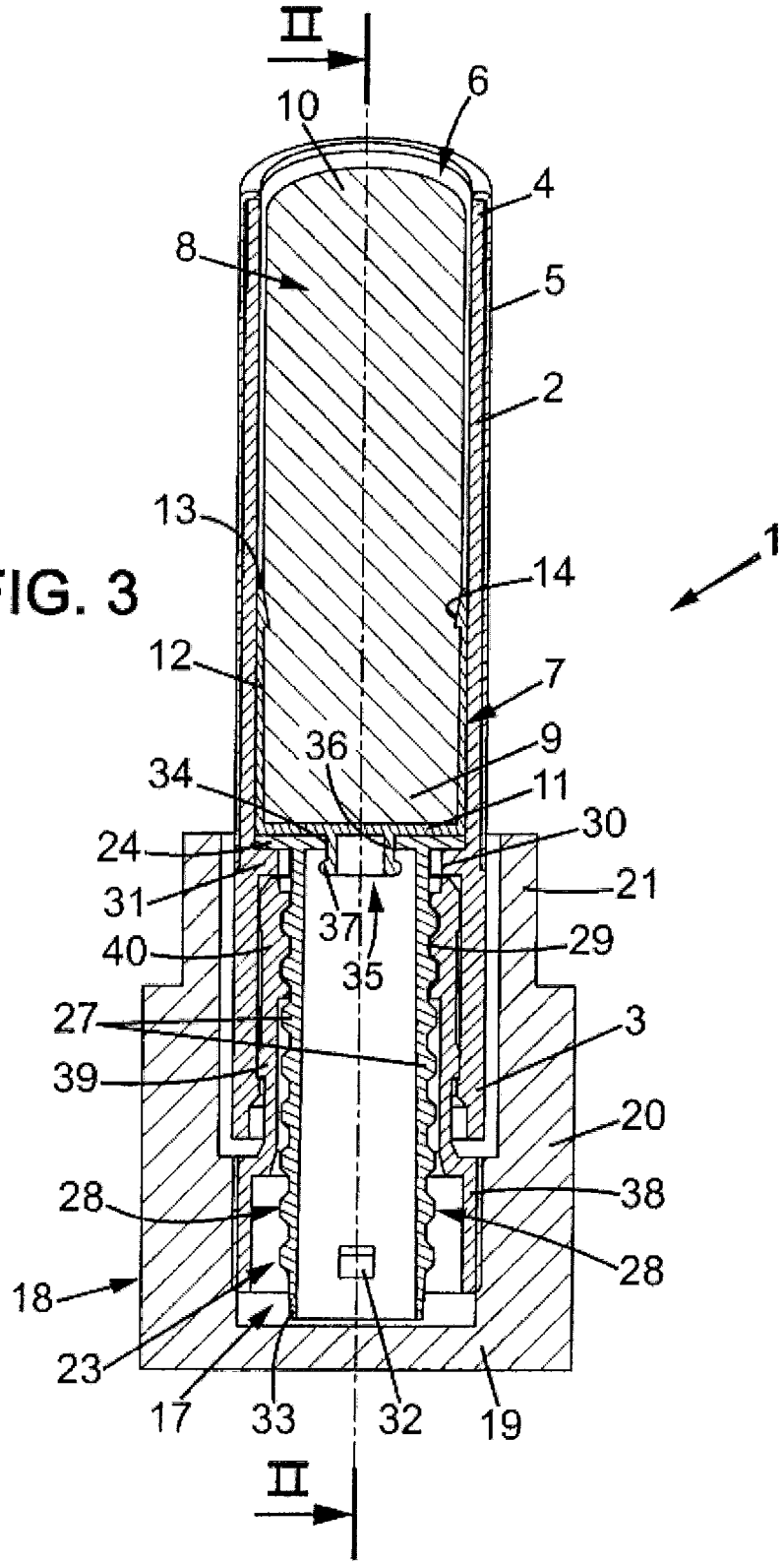
FIG. 3 is an axial cross-sectional view of the application device of FIG. 1, without its cap, along line III-III of FIG. 2.

The base 18 may be assembled to rotate relative to the protective tube 2 about the central axis X, to control the sliding of the stick 8 of material between its retracted position and its usage position. As represented in FIGS. 2 and 3, the control mechanism 17 may possibly comprise:

- a screw 23 extending longitudinally along the axis X and integrally attached to a sliding element 24 which slides along the axis X inside the protective tube 2,
- and a nut 25 which is screwed onto the screw 23 and which is attached to the base 18 so as to rotate with it.

In the specific example represented in FIG. 2 or 3, the screw 23 may be made of the same piece of plastic as the sliding element 24, and the nut 25 may also be made of plastic.

The screw 23 may be in the form of a hollow stem having:

- two flat and opposing sides 26 (see FIGS. 2 and 4) which run parallel to each other and to the axis X, and
- two sides 27 in the shape of cylinder portions centered on the axis X, as can be seen in FIG. 3, which are diametrically opposite each other and which are connected to the flat sides 26. The sides 27 in the shape of cylinder portions have an external thread 28 which engages with an inside thread 29 in the nut 25 (see FIGS. 3 and 4).

Figure 4:
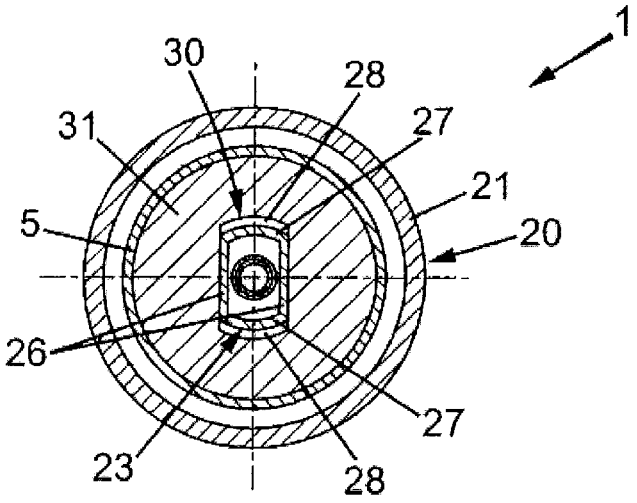
FIG. 4 is a transverse cross-sectional view along line IV-IV of FIG. 2.
Figure 5:
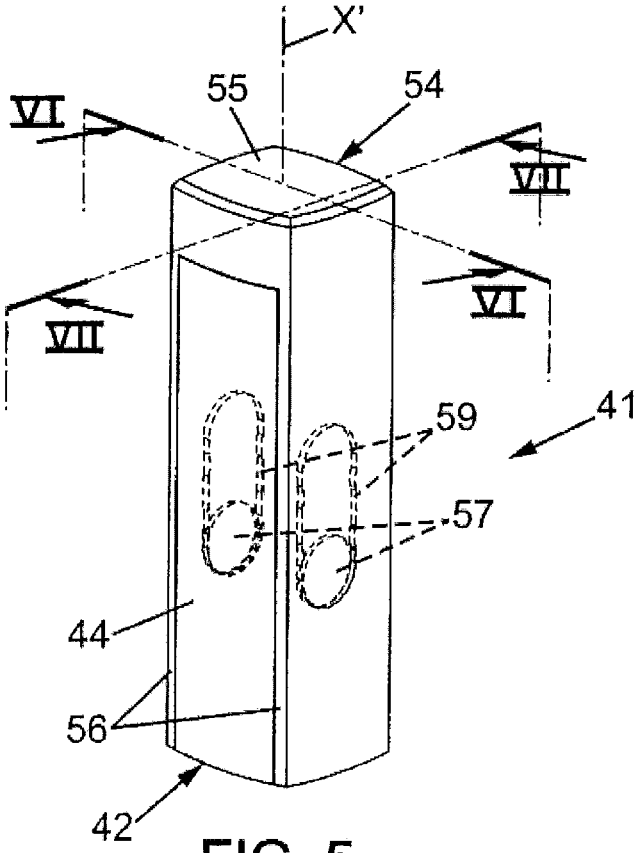
FIG. 5 is a perspective view of a refill for the application device of FIGS. 1 and 4, FIGS. 6 and 7 are perspective and cross-sectional views of the refill of FIG. 5, showing the respective cross-sections along planes VI-VI and VII-VII of FIG. 5.

The screw 23 extends from the sliding element 24 to the bottom 19 of the base 20, passing through an opening 30 in a transverse wall 31 which may be formed from the same part as the protective tube 2, of plastic, and which extends radially inward in this protective tube at an intermediate position between the first and second ends 3, 4 of said protective tube. As represented in FIG. 4, the opening 30 may have a shape that is substantially complementary to the external shape of the screw 23, to prevent the screw 23 from rotating around the axis X (the two flat sides 26 of the screw 23 are in sliding contact with the two opposing straight edges of the opening 30), while allowing the screw 23 to move translationally inside the protective tube 2, along the axis X, with the sliding element 24.

The movement of the screw 23 inside the protective tube 2 is limited:

- downwards (meaning towards the base 18) by the sliding element 24 being stopped by the transverse wall 31,
- and upwards (meaning towards the second end of the protective tube 2), for example by the contact of two elastic tabs 32 against the transverse wall 30.

These elastic tabs 32 may, for example, be molded from the same part as the screw 23, near the free end 33 of this screw 23, and said elastic tabs 32 may be adapted to pass through the opening 30 in the transverse wall 31 by elastically deforming when the screw 23 is first installed in the protective tube 2. For this purpose, the elastic tabs 32 are deformable radially inwards and each one may have, if necessary, a sloped surface 32*a* extending at an upward angle and radially outwards from one of the flat side walls 26 of the screw, and a upper stop surface 32*b* extending substantially perpendicularly to the axis X (see FIG. 2).

The sliding element 24 itself may, for example, be in the form of a simple plate extending perpendicularly to the axis X, as represented, or in the form of a dish opening towards the second end 4 of the protective tube, or in any other form. This sliding element 24 is equipped, in the example considered here, with a central opening 34 into which an elastic lug 35 may be clipped in place, formed of a single piece under the bottom 11 of the abovementioned cup 7. This elastic lug 35 may, for example, have a lateral wall 36 having a substantially cylindrical symmetry centered on the axis X, having at its free end a lip 37 protruding radially outwards and adapted to retain the cup 7 in a removable manner on the sliding element 24, by clipping it in place in the opening 34.

Lastly, the abovementioned nut 25 may, for example, have a lower portion 38 that may or may not be grooved, which is forced into a complementary inner portion arranged in the base 20. This lower portion 38 is annular in shape, and surrounds the screw 23 without interfering with this screw. Said lower portion 38 is extended towards the transverse wall 30 of the protective tube by an intermediate annular portion 39 which itself is not threaded, then by an upper portion 40 which is equipped with the abovementioned inside thread 29.

By means of the control mechanism 17, the base 20 is rotated relative to the protective tube 2 about the axis X, by sliding the sliding element 24 and the cartridge 6 of material in a manner that causes the stick of material to protrude from or withdraw into the protective tube 2.

Of course, the particular control mechanism described above is only provided as an example. Other control mechanisms may be used to control the movement of a stick of material, particularly control mechanisms which make use of grooves in parts arranged concentrically to the stick 8 of material, as is well known in the prior art.

b) Refill

FIGS. 5 to 8 represent an example of a refill 41 used to change the cartridge 6 of material in the application device 1 described above.

Figure 6:
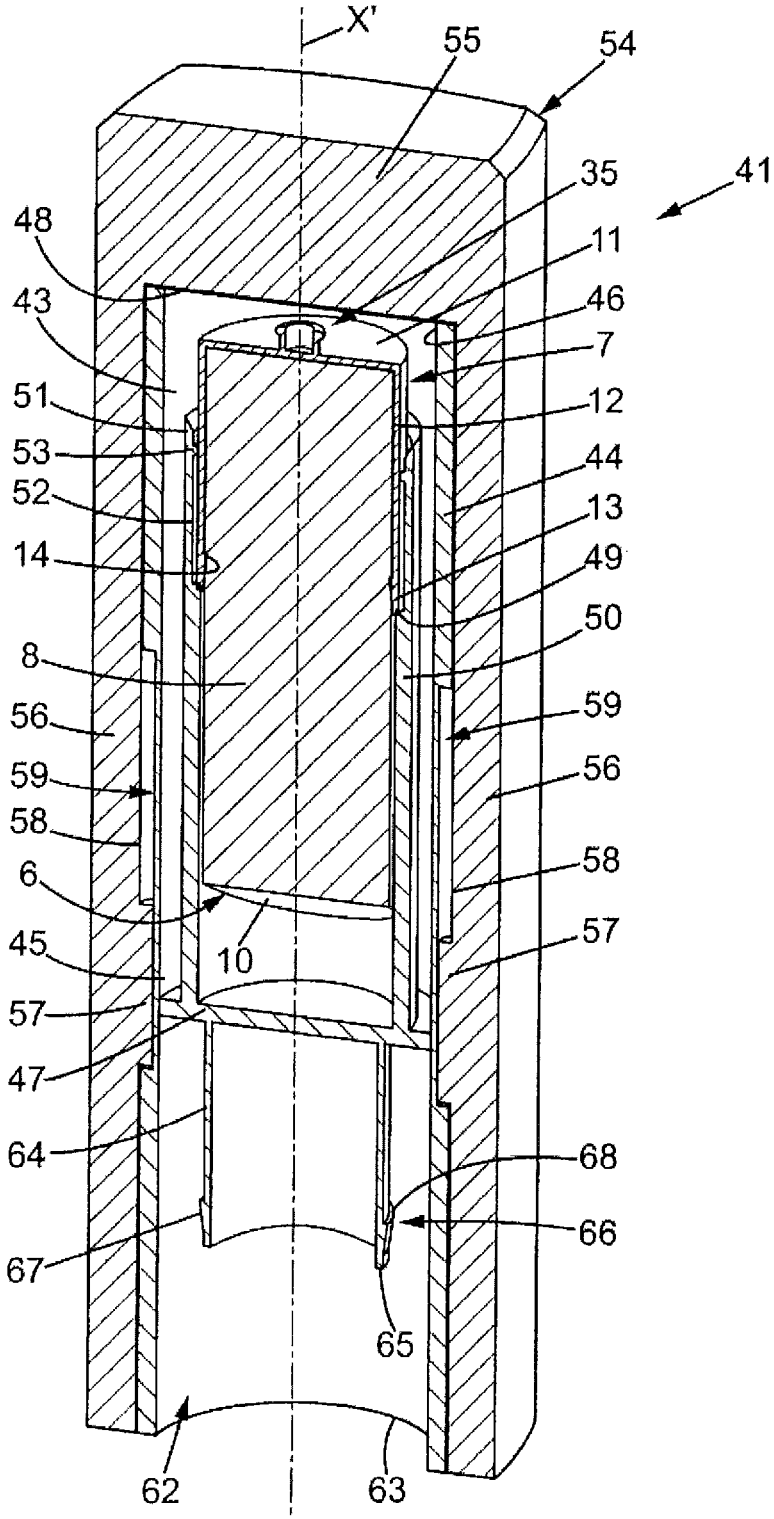

This refill 41 comprises a casing 42, made for example of plastic, which delimits a refill housing 43 containing a new cartridge 6 of material, identical to the cartridge 6 described above in the context of the application device 1 (see FIG. 6).

The casing 42 may possibly have an external shape that is substantially a parallelepiped, and may have an elongated form extending longitudinally along a central axis X'. The refill housing 43 may have a cylindrical shape centered on the axis X'.

The casing 42 may have an annular internal lateral wall 44 which delimits the refill housing 43, said refill housing extending along the central axis X' between a first end 45 and a second end 46. The first end 45 of the refill housing 43 may be closed off for example by a transverse partition 47 formed from the same part as the lateral wall 44 of the refill casing. The second end 46 of the refill housing is open and may possibly be temporarily closed off by a removable protective membrane 48 which may for example be heat sealed or glued onto the end face of the lateral wall 43 (see FIGS. 6 and 8).

As represented in FIG. 6, the new cartridge 6 of material is placed in the refill housing 43, with the bottom 11 of its cup near the second end 46 of the refill housing and with the distal end 10 of its stick of material near the first end 45 of the refill housing.

The cartridge 6 is held in place in the refill housing by inserting its cup 7 into the second end 46 of the refill housing, said refill housing comprising a shoulder 49 which is directed towards said second end 46 such that it can press against the cup in the axial direction X'. The shoulder 49 can thus exert pressure on said cup 7 in the axial direction X' during the placement of the new cartridge 6 on an application device 1 after a used cartridge 6 is extracted from said application device, as will be explained below.

More specifically, in the example considered here, the refill housing 43 comprises a cup holding means, which is an annular inner wall 50, of a substantially cylindrical general shape centered on the central axis X', which may be molded from the same piece of plastic as the casing 42 and which may extend along the central axis X' from the transverse partition 47 to a free end 51 located near the second end 46 of the refill housing.

This annular wall 50 may have, near its free end 51, a terminal portion 52 having an enlarged inside diameter which delimits said shoulder 49. The lateral wall 12 of the cup of the new cartridge 6 is inserted into this terminal portion 52, with the free end 13 of this lateral wall pressing against said shoulder 49.

The annular wall 50 may comprise, near its free end, an annular inner lip 53 which is in contact with the lateral wall 12 of the cup and which allows gentle insertion of the cup into the annular wall 50.

The casing 42 of the refill may additionally comprise a cap 54 for temporarily closing the second end 46 of the refill housing.

This cap 54 may possibly be pivotably mounted on the lateral wall 44 of the casing. For this purpose, the cap 54 may for example be stirrup-shaped, including:

- a central portion 55 for covering the second end 46 of the refill housing,
- and two arms 56 assembled to pivot on two respective pivots 57 on two opposite sides of the lateral wall 44 of the casing 42.

The arms 57 may additionally be assembled to slide relative to the lateral wall 44 of the casing, between:

- a closed position in which the central portion 56 of the cap is pressing against the end face of the casing to close the second end 46 of the refill housing 43,
- and a released position in which the cap is moved away from said second end 46 of the refill housing, the released position being such that the central portion 55 of the cap is sufficiently distanced from said second end 46 of the refill housing 43 to allow the cap to pivot and leave unobstructed said second end 46 of the refill housing.

Figure 7:
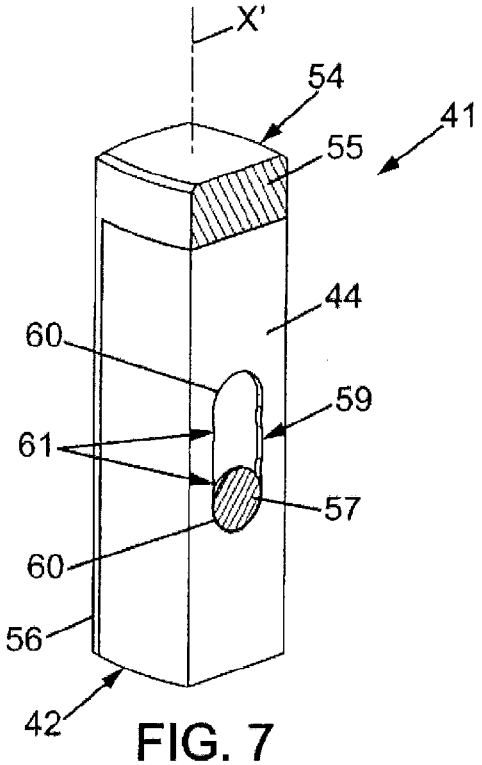
Figure 8:
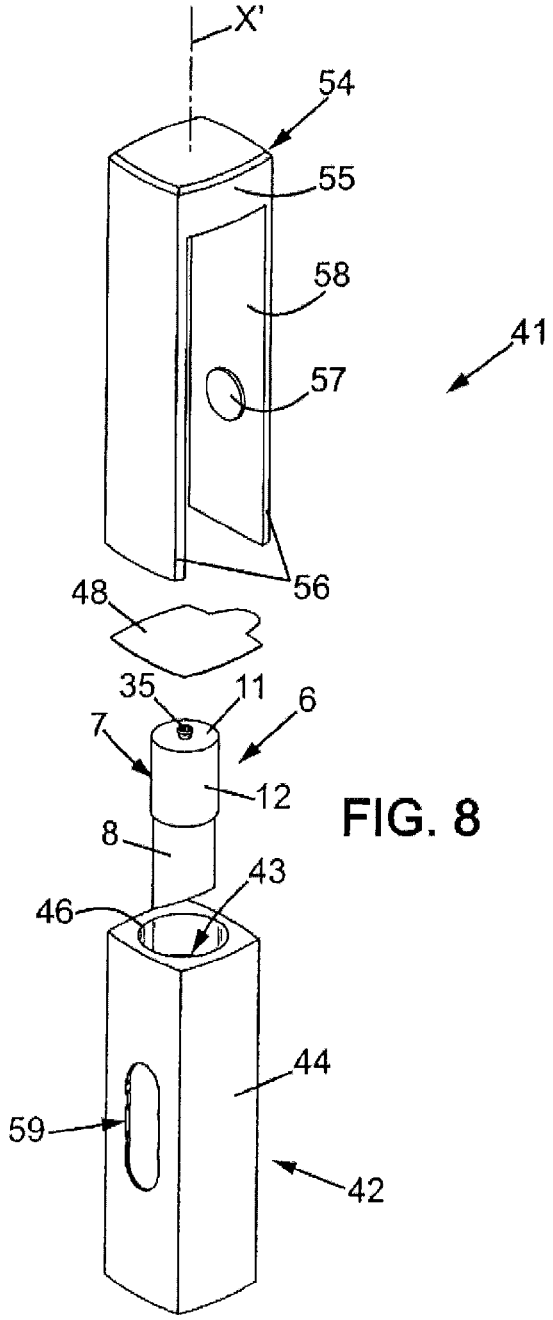
FIG. 8 is a exploded perspective view of the refill of FIGS. 5 to 7.

In the particular example represented, the pivots 57 are respectively formed on the inner sides 58 of the arms 56 (see FIGS. 6 to 8) and these pivots 57 are assembled to slide in two respective grooves 59 which are arranged in the faces of the lateral wall 44 facing the arms 56. Each of the grooves 59 opens towards the corresponding arm 56 and extends longitudinally parallel to the central axis X'. Advantageously, each groove 59 may comprise one or more narrowed portions 61 which delimit at least one retaining slot 60 at the end of the groove 59 that is opposite the second end 46 of the refill housing 43. This retaining slot 60 receives the corresponding pivot 57 when the cap 54 is in the closed position, as represented in FIGS. 6 to 8, and then prevents said pivot 57 from sliding unintentionally.

It is possible for each groove 59 to also have a second narrowed portion 61 at its opposite end, defining a second retaining slot 60 for holding the pivots 57 in position when a user slides the cap 54 into the released position. The narrowed portions 61 are sufficiently unpronounced to allow them to deform elastically and accommodate the passage of the pivots 57 when a user wants to slide the cap 54.

As represented in FIG. 6, the refill casing 42 may additionally comprise an extraction housing 62, which may be cylindrical in shape and centered on the axis X' and be open opposite the refill housing 43. This extraction housing 62 may extend along the axis X', from the transverse partition 47 to an open end 63, and may contain at least one extracting member 64 which is adapted to penetrate into what remains of the stick 8 of material in a used refill 6 of an application device 1. This extracting member 64 has an outer lip 66 adapted to cooperate with the inner lip 14 of the cup of the used cartridge in a manner that retains said inner lip and allows extraction of the used cartridge from the application device.

In the first embodiment of the invention, the extracting member has at least one wall extending along the axis X', from the transverse partition 57 towards the open end 63 of the extraction housing, out to a free end 65 which has the outer lip 66, said outer lip 66 being shaped to catch under the inner lip 14 of the cup of the used cartridge. More specifically, the outer lip 66 of the extracting member 64 may comprise a shoulder 68 directed towards the transverse partition 57 and adapted to catch under the inner lip 14 of the cup of the used cartridge. Advantageously, the outer lip 66 may also have a sloped surface 67 extending radially outwards, at an angle, in the direction of the transverse partition 47, to the shoulder 68, which may be perpendicular to the axis X'.

In the example represented in the drawings, the extracting member 64 is in the form of a ferrule that is substantially cylindrical in shape and centered on the axis X', but this ferrule may, for example, be replaced with a plurality of tabs each of them having an outer lip 66.

The refill 41 just described can be used as follows.

Figure 9:
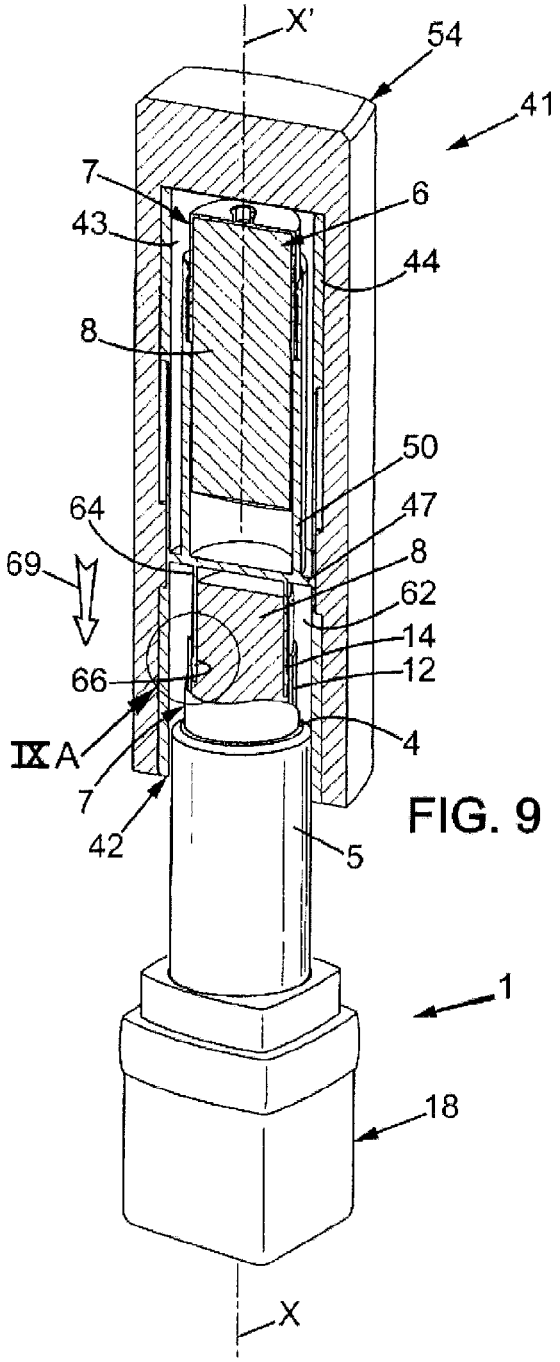
FIG. 9 is a perspective cutaway view illustrating a used cartridge of material hooked by the refill casing.

When the stick 8 of material of an application device 1 is near the end of its service life, as represented in FIG. 9, the second end 4 of the protective tube 2 of this application device 1 is fitted into the extraction housing 62 of the refill casing 41. Advantageously, the inside diameter of the extraction housing 62 is substantially equal to the outside diameter of the metal ferrule 5 (or the outside diameter of the protective tube 2 if it does not have such a ferrule 5), so that this insertion aligns the central axis X' of the refill 41 with the central axis X of the application device 1.

Figure 9A:
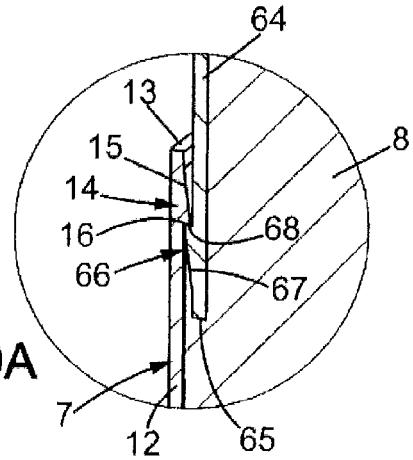
FIG. 9A is an enlarged view of the IXA details of FIG. 9.

During this movement, when the user applies pressure to the refill 41 in the direction of the arrow 69, the extracting member 64 penetrates into the used stick 8 of material, at the edges of this stick, and penetrates the lateral wall 12 of the cup. The product forming the stick 8 of material is sufficiently soft to allow this penetration. The outside diameter of the extracting member 64 is substantially equal or slightly less than the inside diameter of the lateral wall 12, aside from the lips 14 and 66, such that the free end 65 of the extracting member 64 can penetrate without difficulty into the free end 13 of the cup 7, then the sloped side 15 and the sloped surface 67 cooperate together while elastically deforming the extracting member 64 and the lateral wall 12 of the cup to allow the outer lip 66 of the extracting member to pass the inner lip 14 of the cup, after which the outer lip 66 of the extracting member hooks under the inner lip 14 of the cup and clips in place, as represented in more detail in FIG. 9*a*.

Figure 10:
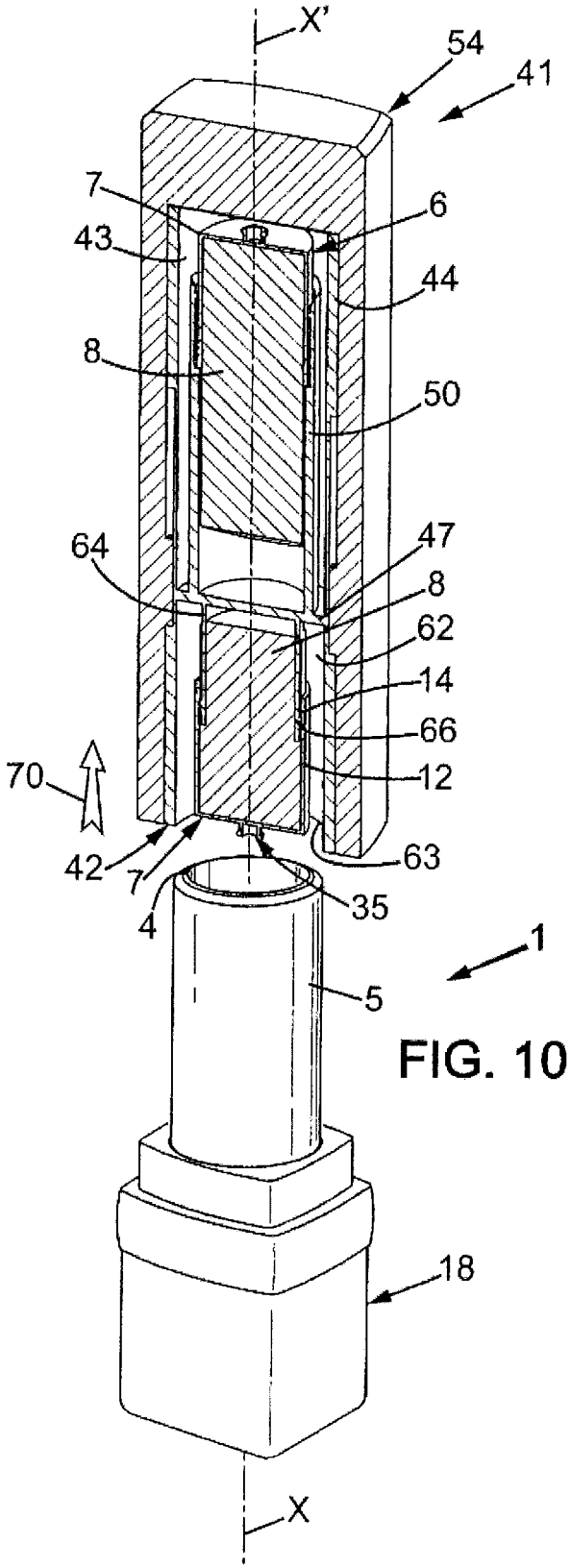
FIG. 10 is a perspective cutaway view illustrating the extraction of the used cartridge using the refill casing.

The used cartridge 6 of the application device 1 is then solidly clipped onto the extracting member 64, such that the user can detach this used cartridge 6 from the sliding element 24 of the application device, by exerting pull on the refill 41 in the direction of the arrow 70 (see FIG. 10). The used cartridge 6 is thus entirely contained inside the extraction housing 63 of the refill 41 and the operation of extracting this used cartridge occurs easily and without soiling the user.

Figure 11:
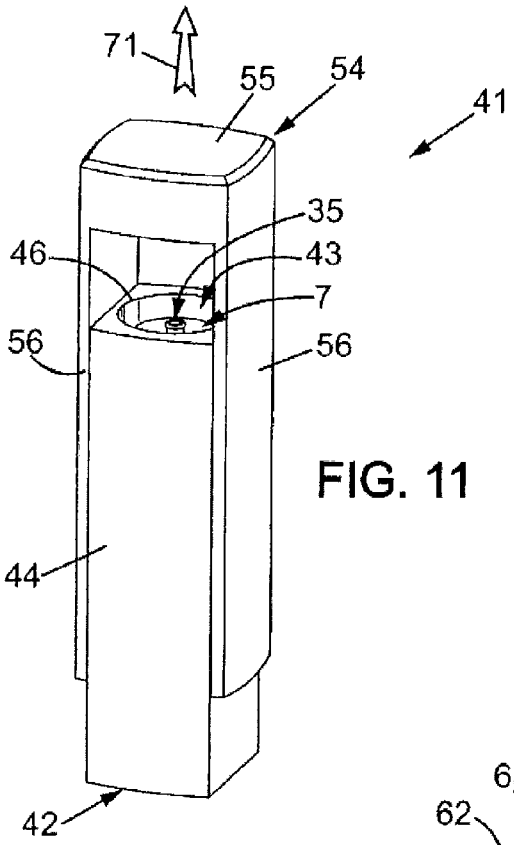
FIGS. 11 and 12 are perspective views illustrating the pivoting of the refill cap to uncover a cartridge of new product contained in the refill after extraction of the used cartridge.
Figure 12:
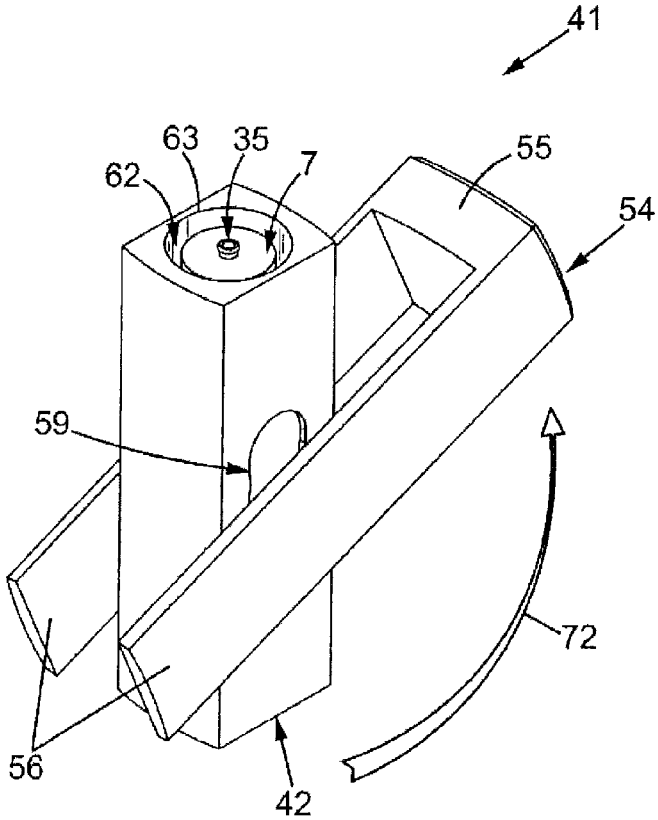

When the user wishes to install the new cartridge 6 of the refill 41 in the application device 1, she opens the second end 46 of the refill housing 43, as represented in FIGS. 11 and 12.

For this purpose the user therefore first raises the cap 54 by sliding the pivots 57 of this cap along the corresponding slits 59 in the refill casing 42, in the direction of the arrow 71 in FIG. 11.

The cap is then in its released position, which allows it to pivot freely on the casing 42, as represented by the arrow 72 in FIG. 1. If the second end 46 of the refill housing 43 was initially sealed by the abovementioned membrane 48, the user removes the membrane 48 during this operation, and said user also orients the refill 41 so that the refill housing 43 is facing the second end 4 of the protective tube 2 of the application device 1.

Figure 13:
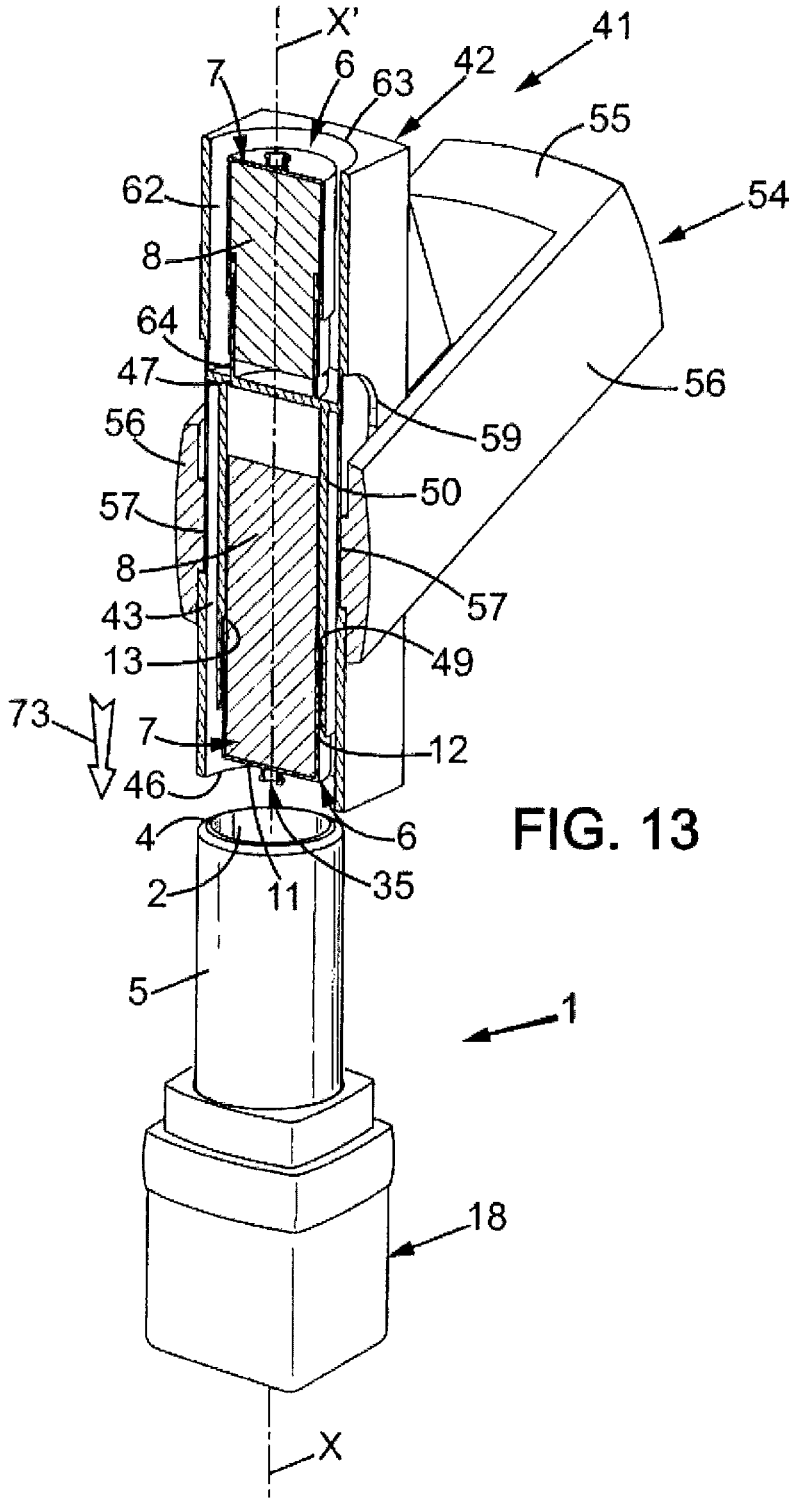
FIG. 13 is a perspective cutaway view illustrating the installation of the new cartridge by the refill, on the application device.

As represented in FIG. 13, the user then inserts the protective tube 2 of the application device in the refill housing 43 of the refill, said refill housing having an inside diameter that is substantially equal to the outside diameter of the ferrule 5 of the protective tube 2 (or substantially equal to the outside diameter of the protective tube 2 if the ferrule 5 is omitted), such that the central axis X' of the refill is then aligned with the central axis X of the application device when the refill 41 is engaged with the protective tube 2 by movement in the direction of the arrow 73 visible in FIG. 13. Also, the outside diameter of the annular wall 50 of the refill housing may be substantially equal to the inside diameter of the protective tube 2, such that it can be inserted into the protective tube 2 during this movement, contributing to guiding the refill 41. It is particularly preferable to have a recentering means between the lower portion of the refill device 43 and the ferrule 5 in preparation for hooking the used refill.

The user then presses on the casing 42 of the refill 41 in the direction of the arrow 73, or on the cap after having repositioned it along the axis XX', until the elastic lug 35 of the cup 7 of the new refill 6 snaps into the central opening 34 of the sliding element 24 that is part of the application device 1. This snapping into place can be evidenced to the user by the characteristic clicking noise emitted by the elastic lug 35 as it snaps into place. She then pulls the refill 41 in the direction opposite the arrow 73. The application device 1 is then in the situation in FIGS. 2 and 3, with a new cartridge of material 6.

The user preferably ensures before each refilling step, particularly during placement of a new cartridge of product, that the cup carrying the used stick of material is placed in the lowest position possible, to limit the risk of damaging the application device during the hooking process. The same is true for the new stick of material during the final step of removing the refill.

The second and third embodiments of the invention, represented in FIGS. 14 to 20*a*, have numerous points in common with the first embodiment of the invention and will therefore not be described in their entirety below. Only the differences in these second and third embodiments of the invention relative to the first embodiment described above will be detailed, it being understood that the advantages already described for the first embodiment are retained in the second embodiment.

B. Second Embodiment of the Invention

Figure 14:
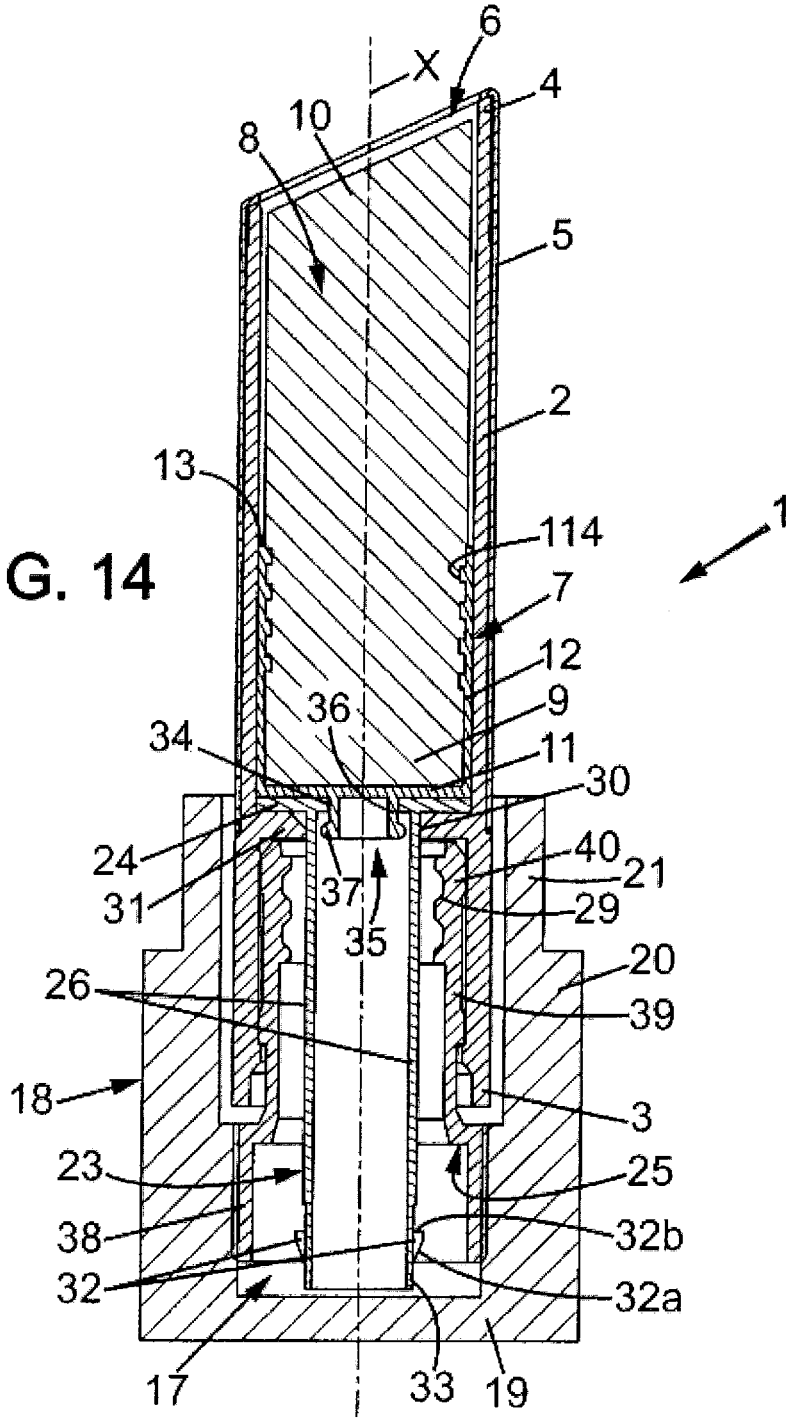
FIGS. 14, 15, 16, 16A, 17 are views respectively similar to FIGS. 2, 6, 9, 9A and 13, in a second embodiment of the invention.
Figure 15:
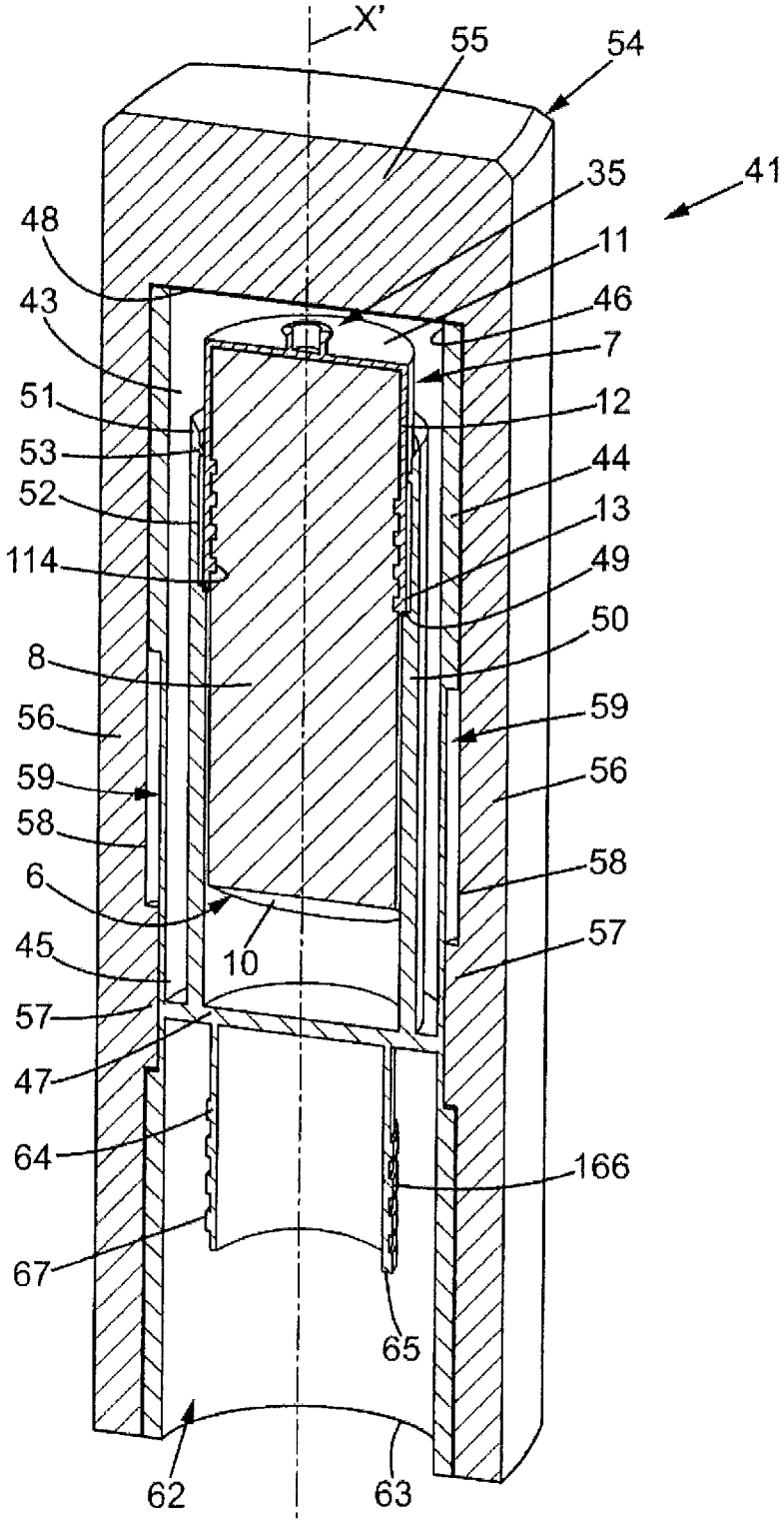

In the second embodiment of the invention, the application device 1 differs from the first embodiment of the invention solely in the fact that the inner lip 114 of the cup 7 is in the form of a thread on the inside face of the lateral wall 12 of this cup, as can be seen in FIGS. 14 and 15. In addition, the outer lip 166 of the extracting member 64 of the refill may also be in the form of an external thread, adapted to screw into the internal threading of the cup 7 of the cosmetic cartridge (see FIG. 15).

Figure 16:
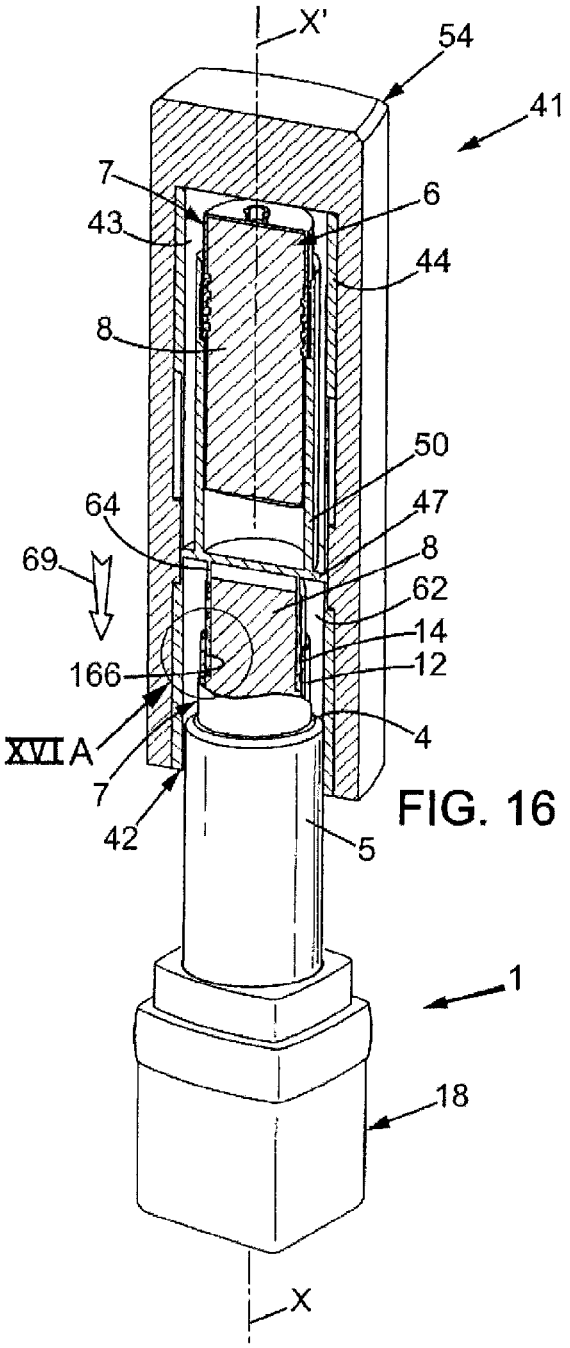
Figure 16A:
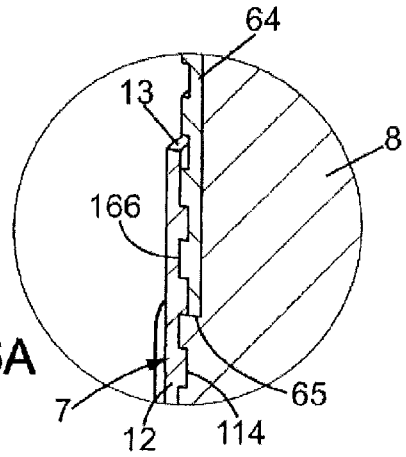
Figure 17:
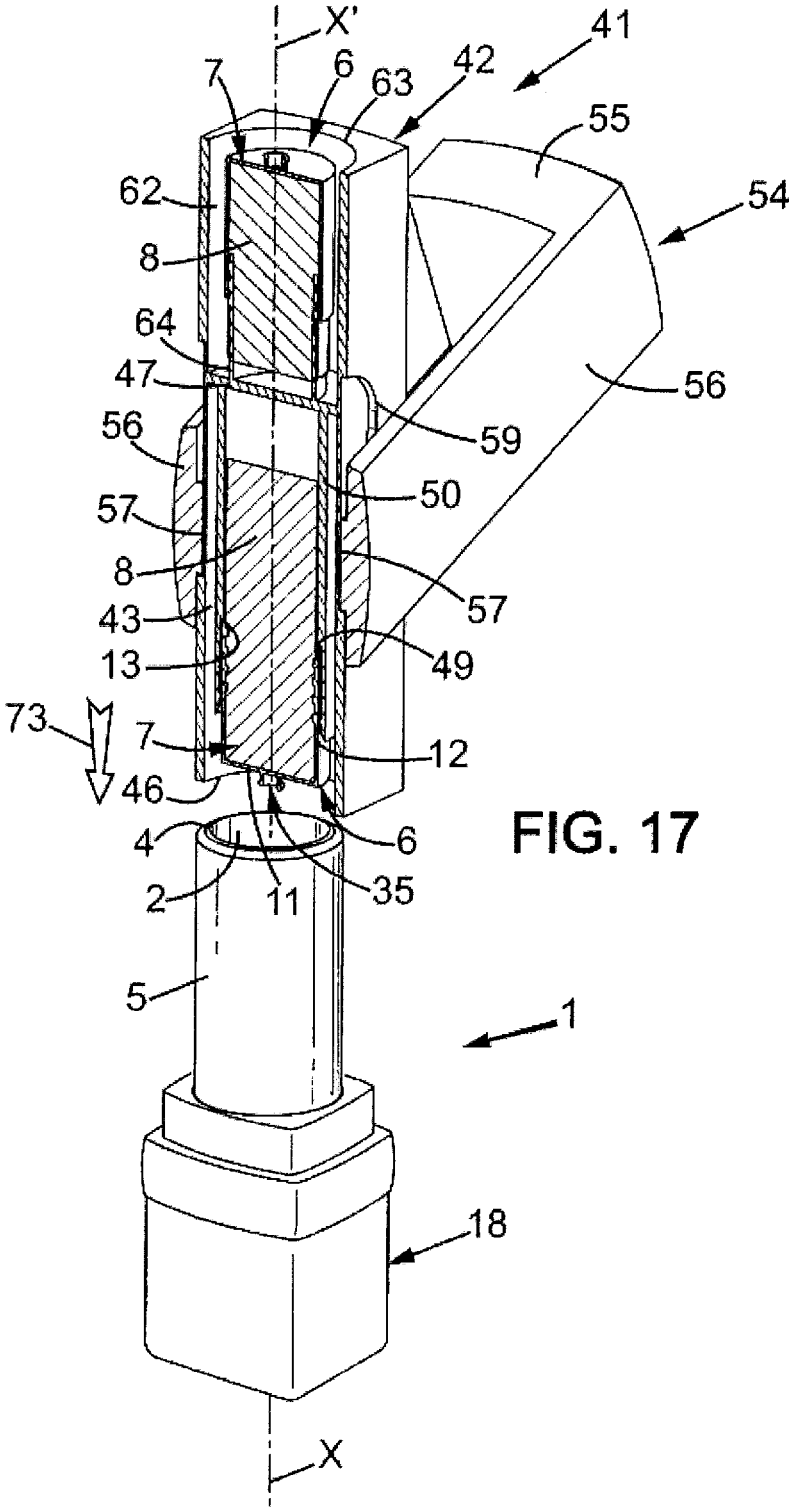

Thus, as represented in FIGS. 16 and 16*a*, during the operation of extracting the used cartridge 6 from the application device 1, the extraction housing 62 of the refill 41 is first applied in the direction of the arrow 69 so it encases the protective tube 2 of the application device, then the user turns the refill 41 on its central axis X' in the direction that screws the thread 166 of the extracting member 64 onto the internal thread 114 of the cup 7 of the used cartridge while causing the extracting member to penetrate the stick 8 of material, as represented in FIGS. 16 and 16*a*.

The used cartridge 6 can then be extracted from the application device 1 by pulling in the direction opposite the arrow 69, in the same manner as explained above for the first embodiment of the invention, and the new cartridge 6 contained in the refill housing 43 can then be placed on the application device 1 simply by fitting it on in the direction of the arrow 73 (see FIG. 17), in the same manner as in the first embodiment of the invention.

C. Third Embodiment of the Invention

Figure 18:
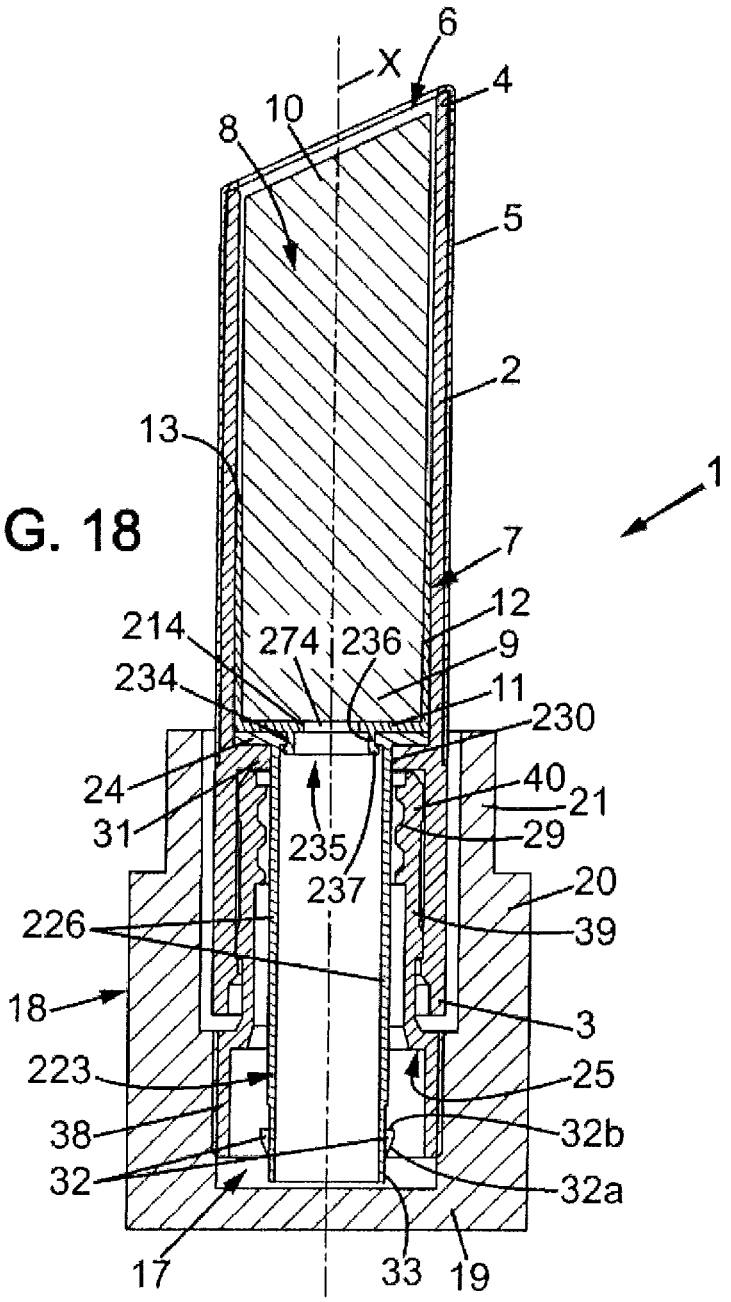
FIGS. 18, 19, 20, 20A, 21 are views respectively similar to FIGS. 2, 6, 9, 9A and 13, in a third embodiment of the invention.
Figure 19:
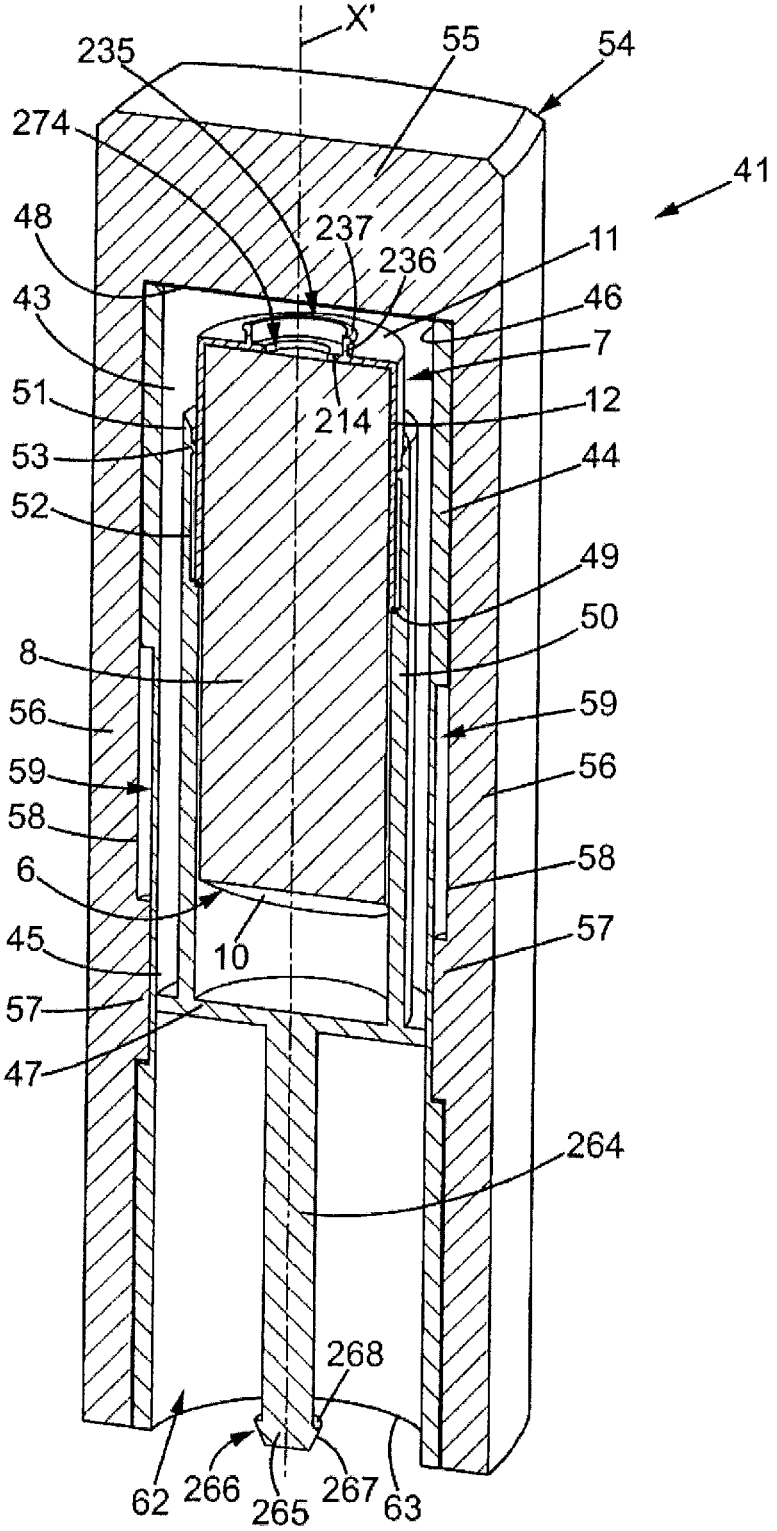

In the third embodiment of the invention, as represented in FIGS. 18 and 19, the cartridge 6 of material is distinguished from that of the first embodiment by the fact that the lateral wall 12 of the cup of this cartridge no longer has an inner lip. However, the edge 11 of this cup has a central opening 274 which delimits an inner lip 214 consisting of the portion of the bottom 11 surrounding the central opening 274, at the center of the elastic lug 235. The lip 214 is covered by the material 8 inside the cup, as in the other embodiments of the invention.

This elastic lug 235 may advantageously have a diameter greater than that of the elastic lug 35 of the first embodiment, said elastic lug 235 having for example a lateral wall 236 forming a cylinder around the axis X, having an external lip 237 at its free end to allow snapping the elastic lug 235 into the central opening 274 of the sliding element 24 of the application device (see FIG. 18). If necessary, this central opening 274 may be larger than the central opening 34 of the first embodiment of the invention, and the screw 223 of the application device can differ from the screw 23 of the first embodiment by the fact that its two flat side walls 226, similar to the sides 26 of the first embodiment, are farther apart from each other than are the flat sides 26 in the first embodiment of the invention.

The opening 230 in the transverse wall 31 is shaped to correspond to the form of the abovementioned side walls 226.

Also, as represented in FIG. 19, the extracting member 264 for extracting from the refill casing 42 may possibly be in the form of a shaft 264 arranged advantageously at the center of the extraction housing 63 and extending along the central axis X' of the refill from the transverse partition 47 to a free end 265 forming a protruding head which delimits the outer lip 266 adapted to cooperate with the inner lip 214 of the cup.

This outer lip 266 may be adapted to attach, and in particular to snap on, to the inner lip 214 of the cup, and said outer lip 266 may advantageously have a sloped surface 267 extending radially outwards, at an angle, in the direction of the transverse partition 47, to a shoulder 268 directed towards said transverse partition 47 and advantageously arranged perpendicularly to the central axis X'.

Figure 20:
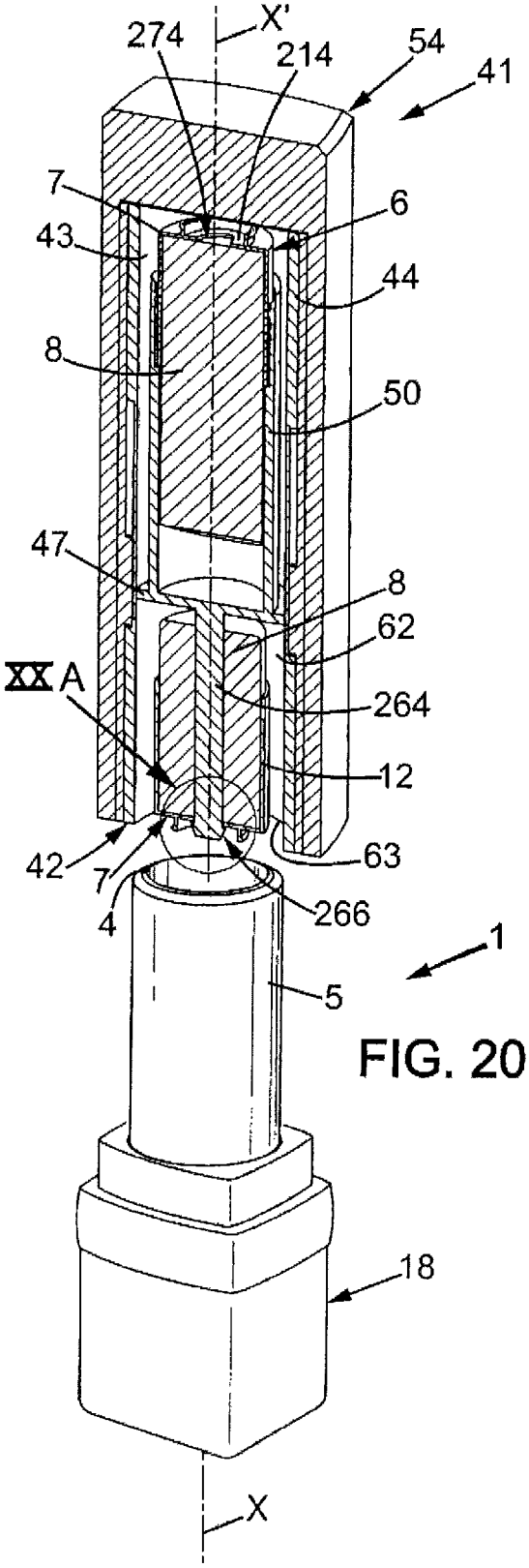
Figure 20A:
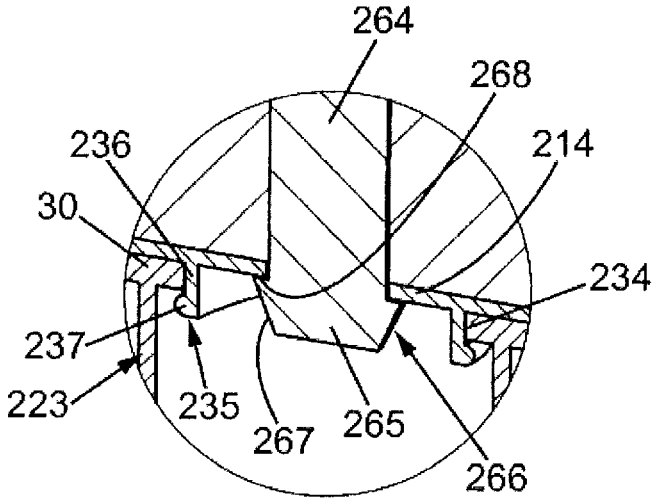
Figure 21:
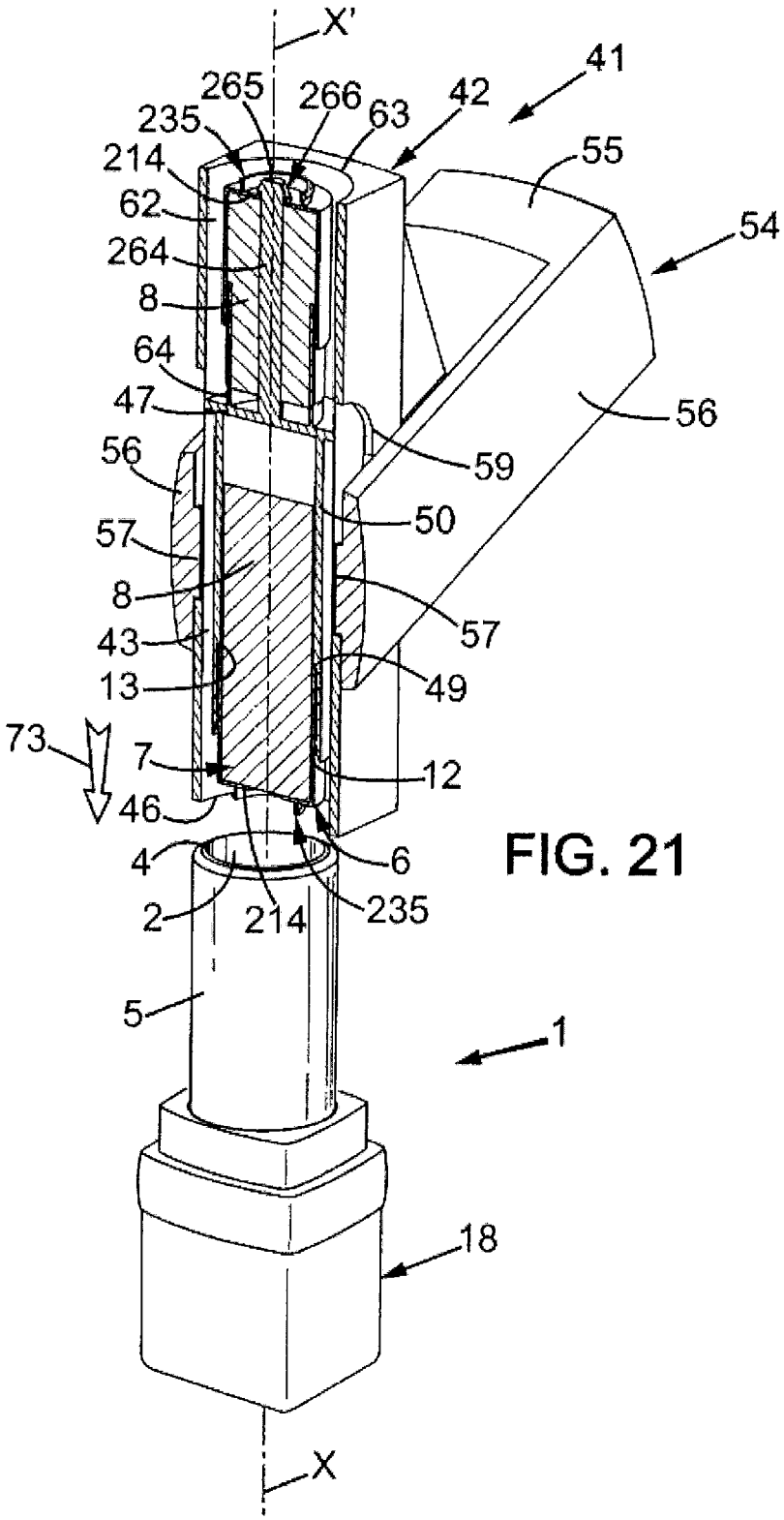

Thus, as represented in FIGS. 20 and 20*a*, when a user wishes to extract a used cartridge 6 from the application device 1, she fits the extraction housing 62 of the refill onto the protective tube 2 of the application device while causing the extracting member 264 to penetrate the stick 8 of material in the used refill, until the lip 266 of the extracting member snaps into place under the inner lip 214 of the cup, after which the used cartridge 6 can be extracted from the application device by pulling on the refill 41 in the direction opposite the arrow 71.

Lastly, placement of the new refill cartridge 6 on the application device 1 occurs in the same manner as in the first two embodiments of the invention, simply by fitting the refill housing 43 of the refill 41 onto the protective tube 2 of the application device, in the direction of the arrow 73, as represented in FIG. 1.

The invention claimed is:

1. A kit comprising:

a) a material application device including:

a protective tube extending in a longitudinal direction between first and second ends, the second end being open, an interchangeable cartridge contained in the protective tube, this cartridge containing a cup and a stick of material, said stick of material extending in said longitudinal direction between a proximal end engaged inside the cup and a distal end at a distance from said cup, the cup comprising an inner lip which is covered by the stick of material inside the cup, a control mechanism for moving the stick of material in the protective tube in the longitudinal direction, such that at least a portion of the stick of material exits the second end of the protective tube, said control mechanism comprising a sliding element to which the cup is removably attached, b) an extracting member adapted to penetrate the stick of material, said extracting member having an outer lip which is solidly attached to said inner lip after penetration into the stick of material, such that the cartridge can be extracted from the application device.

2. The kit according to claim 1, wherein the cup comprises a bottom and a lateral wall into which the proximal end of the stick of material is engaged, said inner lip protruding radially inward from said lateral wall.

3. The kit according to claim 2, wherein said inner lip is an annular lip comprising a shoulder directed towards the bottom of the cup.

4. The kit according to claim 2, wherein said inner lip is a thread.

5. The kit according to claim 1, wherein the cup comprises a bottom in which there is an opening delimited by said inner lip.

6. The kit according to claim 1, wherein the stick of material consists of a paste-like material.

7. The kit according to claim 1, wherein the stick of material consists of a material intended to be applied to the lips, for cosmetic use such as lipstick, or for pharmaceutical use.

8. The kit according to claim 1, additionally comprising a refill containing an interchangeable cartridge removably housed in a casing which comprises a refill housing extending in an axial direction between first and second ends, the second end being open, said cartridge comprising a cup and a stick of material, the bottom of the cup being placed towards the second end of the refill housing so it can be mounted onto the sliding element of the application device, said stick of material of the refill extending longitudinally in the axial direction between a proximal end engaged inside the cup and a distal end at a distance from said cup, the cup of the refill comprising an inner lip which is covered by the stick of material inside the cup, the stick of material of the refill being penetrable by said extracting member which is adapted to be solidly attached to said inner lip of the refill cup to allow extraction of the refill cartridge when it is assembled onto the application device.

9. The kit according to claim 8, wherein the refill cup is fitted into the second end of the refill housing, and said refill housing comprises a shoulder which is directed towards the second end of said refill housing such that it can press against the cup in the axial direction.

10. The kit according to claim 8, comprising a cap for closing the second end of the refill housing.

11. The kit according to claim 10, wherein the cap comprises two arms pivotably mounted on two respective pivots on each side of the refill casing, said arms being adapted to slide relative to the casing between a closed position in which the cap closes the second end of the refill housing and a released position in which the cap is moved away from said second end of the refill housing, the released position being such that the cap is sufficiently distanced from said second end of the refill housing to allow said cap to pivot and leave unobstructed said second end of the refill housing.

12. The kit according to claim 8, wherein the extracting member is integrally attached to the refill casing, said extracting member comprising an outer lip which cooperates with the inner lip of the cup to retain said cup and enable extraction of the cartridge when it is assembled onto the application device.

13. The kit according to claim 12, wherein the refill casing additionally comprises an extraction housing that is open opposite the refill housing and at least partially contains said extracting member, said extracting member being adapted to house a cartridge extracted from an application device and retained by the extracting member.

14. The kit according to claim 1, wherein the cup of the cartridge comprises a bottom and a lateral wall in which the proximal end of the stick of material is engaged, said inner lip protruding radially inwards from said lateral wall.

15. The kit according to claim 14, wherein the outer lip of the extracting member is adapted to catch on the inner lip of the cartridge when it is assembled onto an application device.

16. The kit according to claim 15, wherein the inner lip of the cup is annular and comprises a shoulder directed towards the bottom of the cup.

17. The kit according to claim 15, wherein the outer lip of the extracting member is annular and comprises a shoulder directed towards the refill housing, and the extracting prehension member is in the form of a ferrule.

18. The kit according to claim 14, wherein said inner lip of the cup is a thread and the outer lip of the extracting member is a complementary thread adapted to screw into the inner lip of the cup.

19. The kit according to claim 1, wherein the bottom of the cup comprises an opening delimited by said inner lip and the extracting member comprises at least one shaft which extends out to a free end having a protruding head comprising said outer lip, which is adapted to catch on the inner lip of the cup.

20. A method of using a kit, said kit comprising:

a) a material application device including:

a protective tube extending in a longitudinal direction between first and second ends, the second end being open, an interchangeable cartridge contained in the protective tube, this cartridge containing a cup and a stick of material, said stick of material extending in said longitudinal direction between a proximal end engaged inside the cup and a distal end at a distance from said cup, the cup comprising an inner lip which is covered by the stick of material inside the cup, a control mechanism for moving the stick of material in the protective tube in the longitudinal direction, such that at least a portion of the stick of material exits the second end of the protective tube, said control mechanism comprising a sliding element to which the cup is removably attached, b) an extracting member adapted to penetrate the stick of material, said extracting member having an outer lip which is solidly attached to said inner lip after penetration into the stick of material, such that the cartridge can be extracted from the application device, said method comprising at least an extraction step wherein:

the extracting member penetrates into the stick of material in the cartridge of the application device, the outer lip of said extracting member is solidly attached to said inner lip of the cup, and the cartridge is extracted with the aid of the extracting member.

* * * * *